United States Patent [19]

Mahaffy et al.

[11] 4,373,341

[45] Feb. 15, 1983

[54] EXPANDIBLE PACKAGE FOR DISPENSING CONTAINERS

[75] Inventors: Reid A. Mahaffy, Montclair; George W. Anderson, Little Falls, both of N.J.

[73] Assignee: Mahaffy & Harder Engineering Co., Fairfield, N.J.

[21] Appl. No.: 217,702

[22] Filed: Dec. 18, 1980

[51] Int. Cl.[3] ..... B65D 5/42

[52] U.S. Cl. ..... 60/721; 60/673; 222/386.5; 222/394; 222/399

[58] Field of Search ..... 60/649, 673, 721; 222/386.5, 394, 399

[56] References Cited

U.S. PATENT DOCUMENTS 3,189,231 6/1965 Kibbel et al. ..... 222/386.5 X 3,407,974 10/1968 Chmielowiec ..... 222/386.5

3,718,236 2/1973 Reyner et al. ..... 222/402.1 X

*Primary Examiner*—Allen M. Ostrager

*Attorney, Agent, or Firm*—Parmelee, Bollinger & Bramblett

[57] ABSTRACT

A sealed package for pressurizing the contents of dispensing containers. The package contains chemicals which react to develop gas pressure to expand the package when in the dispensing container. A series of sequentially rupturable pockets add further increments of internal pressure as dispensing proceeds. These pockets, and additional pockets containing chemicals for initiating package pressurization, are formed in an outer film heat-sealed to a second outer film to define the package. The rupturable pockets are covered with a tape to maintain the chemicals isolated until rupture is effected by progressive lift-off of the tape as the package expands.

16 Claims, 8 Drawing Figures

22

29
24
26
20
28
24
24
28
24
26
29

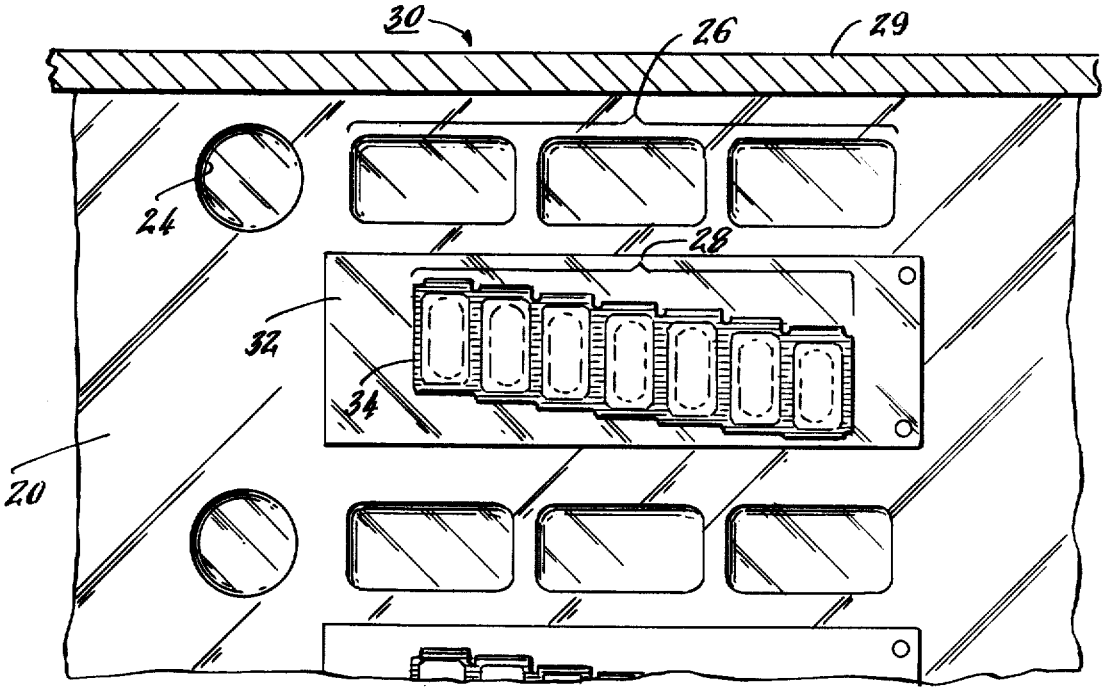
Fig. 2.
Fig. 3.
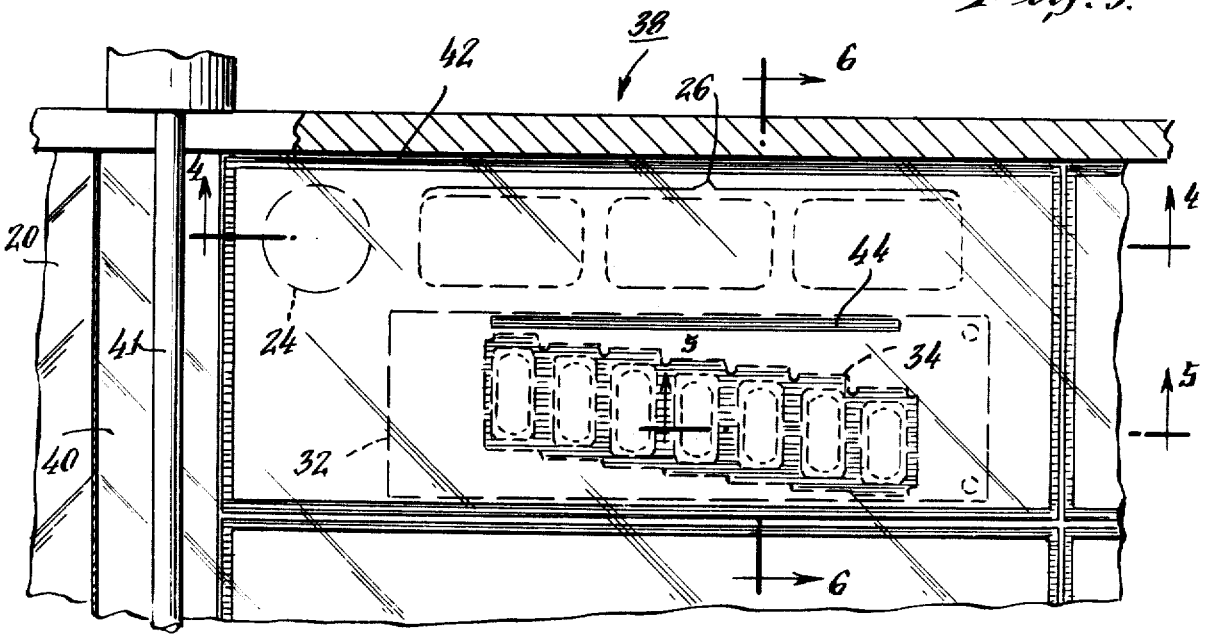

EXPANDIBLE PACKAGE FOR DISPENSING CONTAINERS

BACKGROUND OF THE INVENTION

1. Field of the Invention

This invention relates to product dispensing containers wherein the container contents are forced out by internal pressure, usually under control of a valve at the top of the container. More particularly, this invention relates to a sealed package to be inserted in such a container to develop the dispensing pressure.

2. Description of the Prior Art

U.S. Pat. No. 3,718,236 discloses a system for generating pressure within a dispensing container by mechanically combining two or more reactive chemicals in a sealed bag-like structure free-floating within the container. In one disclosed arrangement, the bag includes a number of sealed compartments containing sodium bicarbonate which are ruptured to combine that chemical with a mixture of citric acid and water so as to develop gas pressure within the bag. The rupturing of these compartments is carried out sequentially as the dispensing operation proceeds, in order to develop successive increments of additional pressurized gas as required to maintain an approximately constant pressure within the container as the contents are dispensed.

The bag-like structures shown in U.S. Pat. No. 3,718,236 are relatively complex and difficult to manufacture by conventional processes. Although the basic structure can be sub-divided into simpler components for separate manufacture, that approach requires processing by at least two different types of machines to make the complete assembly, thus resulting in undesirably high cost.

SUMMARY OF THE INVENTION

In accordance with the present invention, a novel package arrangement, and method of making such a package, provide for complete manufacture of the package on a single machine, e.g. of the thermoform-fill-seal type. This novel package comprises three basic elements: (1) a first sheet member formed with pockets containing the various reactive chemicals, (2) a tape member sealed to the first sheet member in position to cover the openings of certain of the pockets, and (3) a second sheet member sealed peripherally to the first sheet member to form therewith a sealed enclosure encompassing all of the formed pockets and the tape member. The tape is secured to the second sheet member to provide for progressive lift-off of the tape from the covered pockets as to sequentially open the covered pockets, permitting the reactive contents to be delivered as needed to maintain the required container pressure.

Other objects, aspects and advantages of the invention will in part be pointed out in, and in part apparent from, the following description of a preferred embodiment of the invention, considered together with the accompanying drawings.

BRIEF DESCRIPTION OF THE DRAWINGS

FIG. 2 shows the formed bottom sheet of the package with a tape member sealed thereto over certain of the pockets;

FIG. 3 shows the formed bottom sheet with a top sheet sealed thereto and to a part of the tape member;

DETAILED DESCRIPTION OF PREFERRED EMBODIMENTS

Figure 1:
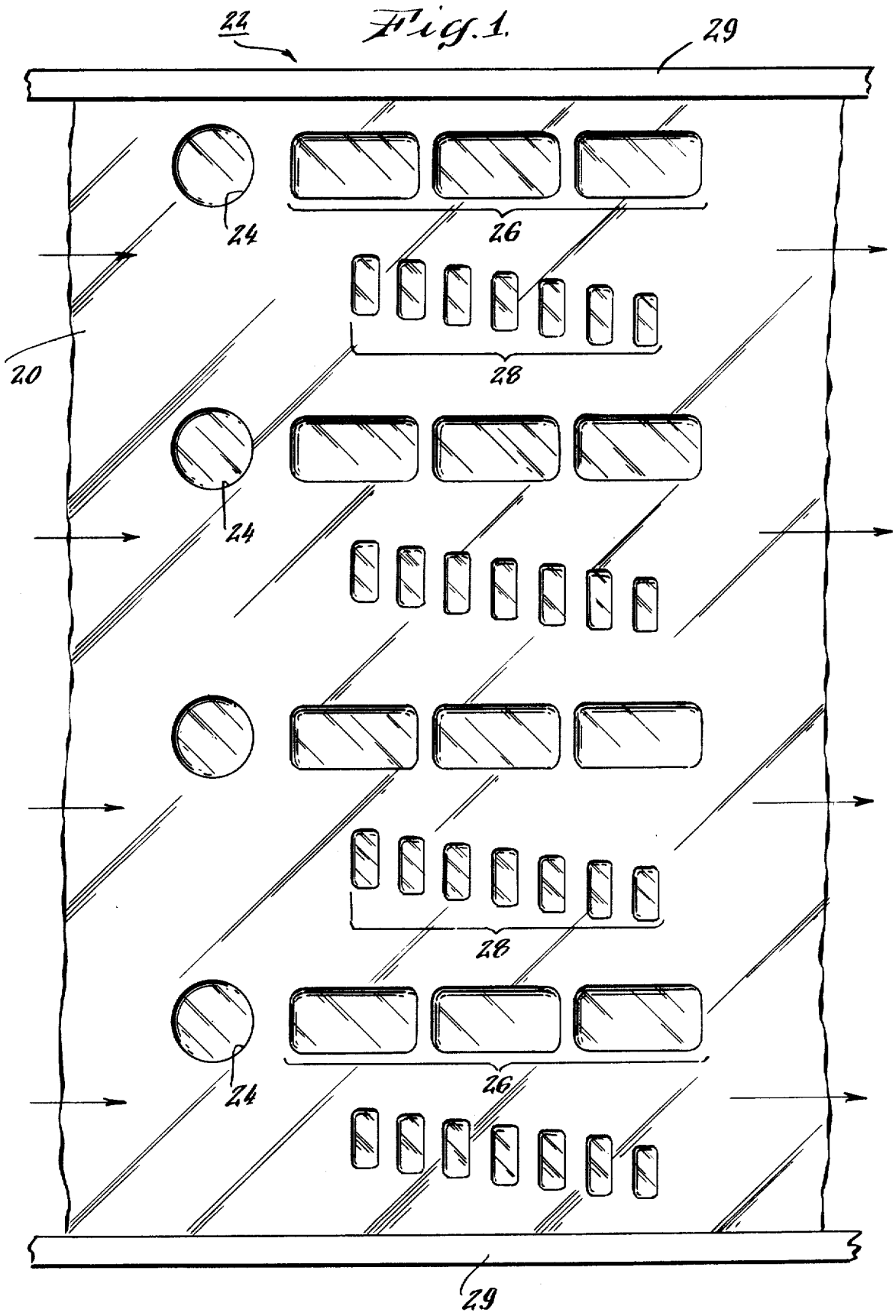
FIG. 1 is a plan view of the initial forming station for forming the bottom sheet of the package with pockets.

Referring now to FIG. 1, there is shown a sheet of flexible plastic packaging material 20 which is transported (from left to right) to a forming station 22 by conventional conveying means (not shown). This sheet may for example be a 2-layer film or web comprising polyethylene/polypropylene, with the polyethylene facing upwards. In the station 22, theremoforming operations are carried out in accordance with known processes to form the sheet 20 with a number of pockets generally indicated at 24, 26 and 28, and adapted to receive chemicals to be reacted together for developing gas pressure.

In typical machine operations, such thermoforming of the sheet 20 preferably is carried out in multiple across the width of the plastic film 20, for example, four abreast, as shown in FIG. 1 between the machine frames 29. However, to simplify the presentation, only one of the four identical formed sections will be described in detail hereinafter.

Returning now to the detailed description, the first of the formed pockets 24 may be circular in plan view, and provides a cell for holding one or more tablets or capsules containing citric acid in solid form. The second of the pockets 26 is developed in this embodiment as three distinct but inter-communicating rectangular cells for holding a mixture of bicarbonate of soda and water. The remaining set of pockets 28 provides a number (seven in this case) of separate but closely adjacent cells for holding citric acid in the form of a solution. The pockets 24–28 are filled with chemical materials as set forth above (not shown in the drawings), in any convenient way, at the station 22 or at a subsequent station.

Thereafter, the formed and filled sheet member 20 is transported to another station 30 (FIG. 2) where a rectangular tape 32 is positioned over the set of pockets 28 and is heat-sealed to the sheet member 20 around the peripheries of the individual cells, e.g. closely adjacent the open mouths of the pockets, as illustrated by the shading at 34. The tape 32 is a strip-like member of flexible plastic material. This tape is heat-sealed uniformly but lightly to the upper surface of the bottom sheet 20 in such a way that it can be pulled away with relatively low force, e.g. 300 to 1000 grams per inch of width. The tape may for example by a 3-layer film comprising polyethylene/polyester/polypropylene, with the polypropylene being the bottom layer sealed to the polyethylene layer of the bottom sheet member 20 and advantageously providing the lightforce peelability as described. Peelability in this case means that the pull force should be sufficiently light that the two films can readily be separated without resulting in any tearing of the films.

Figure 4:
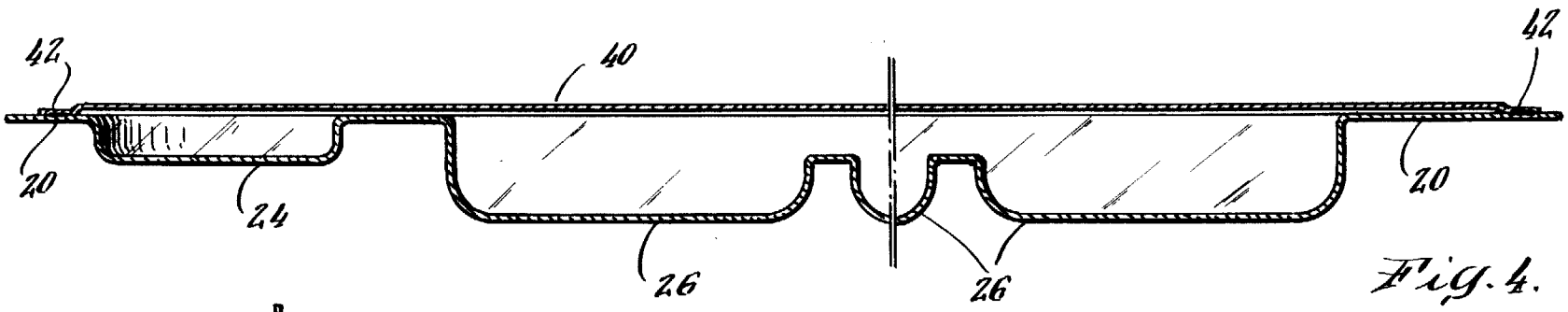
FIG. 4 is a longitudinal section taken along line 4—4 of FIG. 3.
Figure 5:
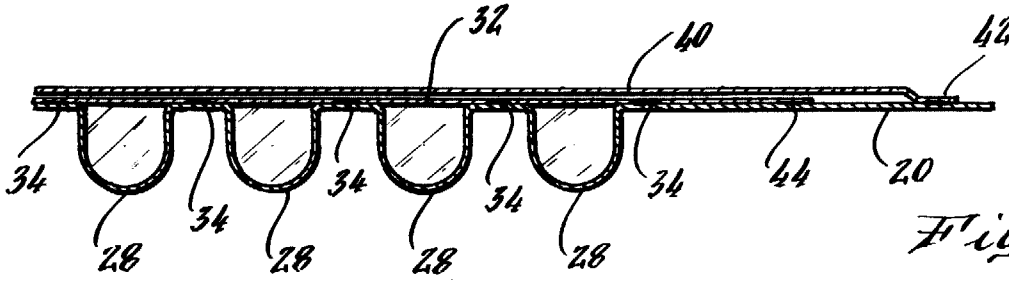
FIG. 5 is a longitudinal section taken along line 5—5 of FIG. 3.
Figure 6:
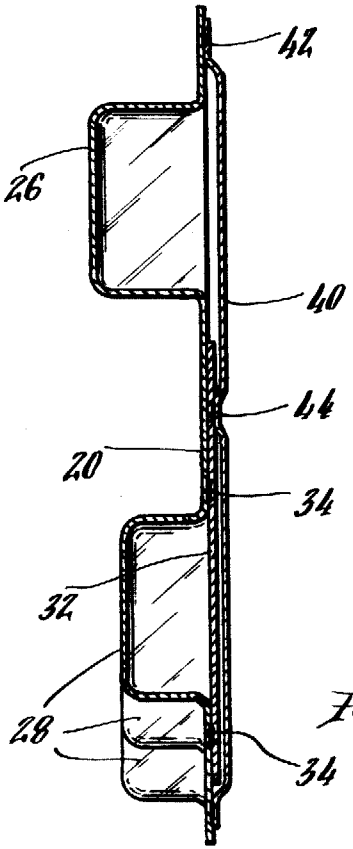
FIG. 6 is a cross-section taken along line 6—6 of FIG. 3.
Figure 7:
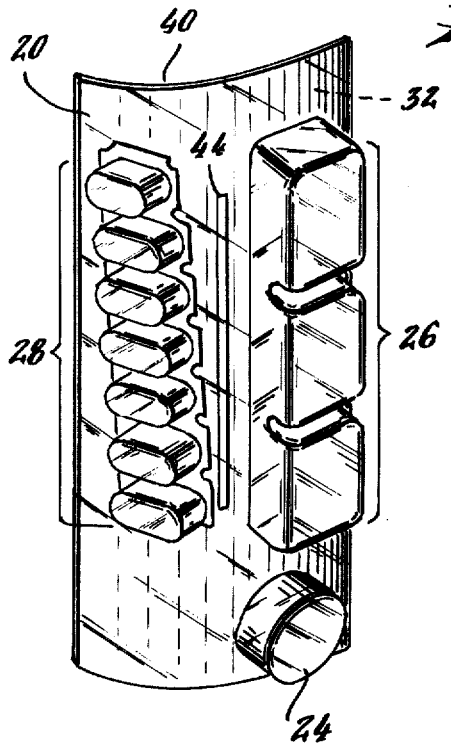
FIG. 7 is a perspective view of the complete package ready for insertion into a container to be pressurized.

With the tape 32 sealed in place as described, the bottom sheet 20 is moved forward to a subsequent station 38 (FIG. 3) where a second sheet of flexible plastic packaging material 40 is applied over the first sheet 20 and the tape 32, as with the aid of a laydown roller 41. This second sheet is heat-sealed in peripheral fashion around the first sheet, as indicated by the shading 42, to form a strongly sealed enclosure encompassing all of the pockets 24–28 as well as the tape 32. This top sheet 40 also is secured to the tape 32, as by heat-sealing the two together along a narrow line 44 adjacent the pockets 28. This seal, like seal 42, is a strong seal capable of holding the films together during normal operation of the package, capable of resisting a force orders of magnitude greater than the force needed to open the peelable seal 34. Thus the seals 42 and 44 effectively serve as welds, whereby application of a sufficiently large force would tear the film material rather than open the seal. FIGS. 4–6 further illustrate the sealing configuration, with certain aspects of the interfilm spacing somewhat exaggerated to clarify the relationships involved. See also FIG. 7 for an overall perspective view of the final package.

The top sheet 40 may for example be a 2-layered film or web consisting of polypropylene/polyethylene, with the polyethylene on the lower (inner) side, facing downwards towards the tape 32. This combination of materials provides for a very strong seal between the top sheet and the tape at 44, and between the top and bottom sheets at 42, because both are polyethylene-to-polyethylene seals.

It may be noted that if the heat applied in making the seal 44 also produces unintended sealing between the tape 32 and the bottom sheet 20, it will be a weak polypropylene-to-polyethylene seal, using the types of sheet and tape materials suggested above, and will not interfere with the pulling of the tape up from the bottom web with only a light pulling force. When making the seal 44, the amount of heat reaching the interface between the tape 32 and the bottom sheet 20 will be significantly less than that producing the seal 34, when using comparable heat sealing devices for both seals 34 and 44, if an inadvertent seal develops along line 44 between the tape and the bottom sheet it will be of even less strength than the light-force seal between the tape and the bottom sheet at the seal line 34. It will of course readily be understood by those skilled in the art that other techniques can be used for establishing a strong secure seal between the top sheet member 40 and the tape 32 along line 44 while assuring that the tape can readily be peeled up away from the bottom sheet member with only a small force.

The completed package thereafter is cut from the forming webs and is ready for use. When the package is tilted, the water and sodium bicarbonate mixture in the cells 26 will flow to the tablets or capsules in cell 24, thus starting gas production within the sealed package. Gas production will normally be slow enough to allow time to load the package into a dispensing container, particularly if known means are employed to slow down the reaction.

As a dispensing operation proceeds, the package expands to fill the space left by the dispensed contents. Thus the two sheet members 20 and 40 are gradually forced apart, especially in the central region adjacent the seal line 44. This expansion thus also lifts up the tape 32 in a progressive fashion, starting at the inner edge of the tape which runs parallel to the seal line 44, and moving outwardly towards the side edge of the package, across the set of pockets 28. Since these pockets are staggered, the progressive lift-up of the tape causes the individual cells to be opened sequentially, thus developing successive additional increments of gas pressure to tend to maintain the internal container pressure approximately constant.

Figure 8:
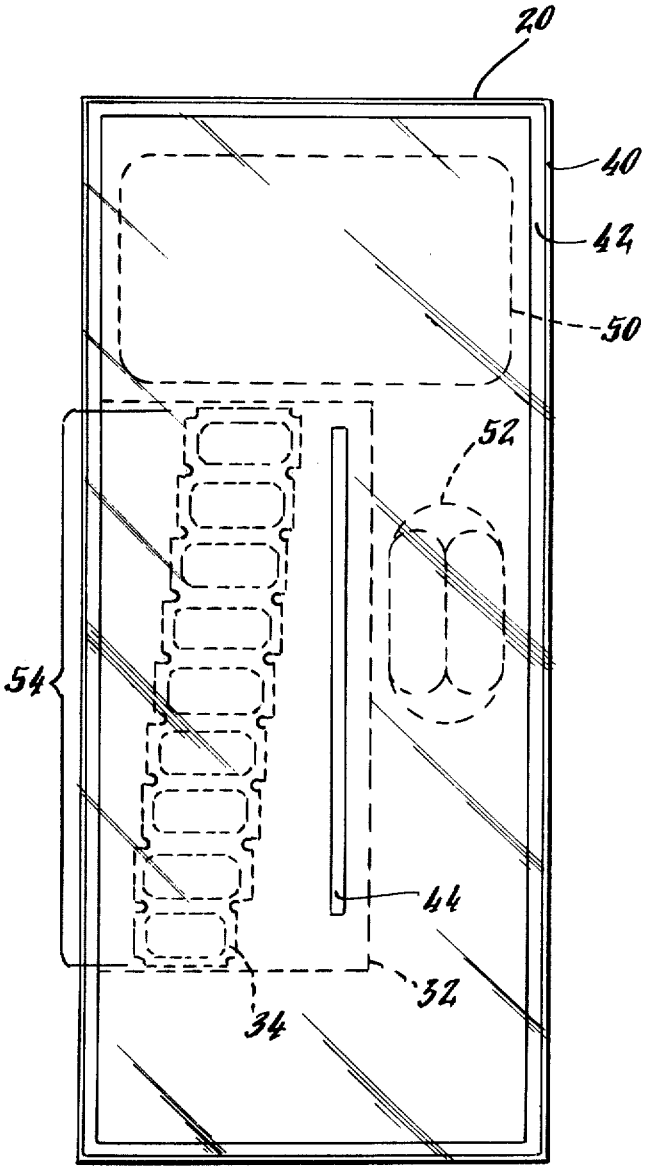
FIG. 8 is a plan view of another embodiment of this invention.

FIG. 8 shows an alternative package design embodying the same basic invention described above, and formed using the same method sequences. In this alternative design, the bottom sheet 20 is first formed with a number of pockets including a generally rectangular pocket 50 at one end of the package. This pocket may be filled with a liquid reactant chemical such as bicarbonate of soda and water. A second pocket 52 of generally oval shape also is formed in the bottom sheet 20 at the same time, in a more central region adjacent one side of the sheet. This pocket may for example receive a solid reactant chemical such as one or more capsules or tablets containing acetic acid crystals, capable of reacting with the bicarbonate of soda in the first pocket 50 to start the initial gas formation.

The bottom sheet 20 of the FIG. 8 design also is formed at the same time with a number of individual cells 54 and filled, for example, with dilute citric acid in liquid form. The openings of these cells then are covered by a single tape member 32 as described above, laid down on the bottom sheet 20, as by a machine operation at the forming station or a subsequent station, and sealed around the cell openings as at 34 to prevent contact between the liquid therein and the remainder of the reactant chemicals placed in the other two pockets. The tape member is secured to the bottom sheet with a relatively weak seal, a described hereinabove, to permit the tape member readily to be pulled up away from the bottom sheet 20 by relatively small force, to open up the cells 54 progressively as the package expands during a dispensing operation.

A top sheet 40 is tne applied over the bottom sheet 20, and is sealed to the bottom sheet around the periphery thereof as shown at 42, to form a strongly sealed enclosure encompassing the pockets 50, 52, 54 and the tape member 32. The top sheet also is sealed to the tape member along a centrally located line 44. This also is a strong seal, to hold those two films together during expansion of the package, thereby to effect lift-off of the tape member 32 from around the cells 54, just as in the first embodiment described. The materials of the top and bottom sheets and the tape member preferably are selected to assure that any unintended sealing effected between the tape member and the bottom sheet, occurring during sealing of the top sheet to the tape member, will be so weak as to be easily broken as force is applied to lift the tape member up from the bottom sheet during expansion of the package. Examples of such film materials are described above with reference to the FIGS. 1–7 embodiment, although other materials can be suitable for these purposes.

The functioning of this alternative package design is the same as in the first embodiment of FIGS. 1–7, in that the reaction of the material in the two larger pockets 50 and 52 provides an initial gas pressurization after the package has been tilted to bring the chemicals together. Thereafter the package is inserted into a dispensing container to apply force to the contents to effect dispensing thereof. The expansion of the package during dispensing pushes apart the bottom and top sheets 20 and 40 thereby lifting up the tape member 32 progressively from the cells 54, to add successive increments of reactant chemical sequentially from those cells to the chemical material which already is producing pressurized gas, thereby to tend to augment the pressurizing gas so as to maintain roughly constant the level of pressurization within the container throughout a complete dispensing operation.

Although preferred embodiments of the invention have been described in detail, it is desired to stress that this is for the purpose of illustrating the principles of the invention, and should not be construed as limiting of the invention since it is apparent that those skilled in this art can make modifications to the disclosed package and packaging methods without departing from the true scope of the invention.

We claim:

1. In a package to be inserted in a container to develop pressure for dispensing the container contents, said package being of the type comprising a sealed enclosure formed by flexible sheet material and containing therewithin a set of chemicals to be reacted together to form an initial gas pressure, said sealed enclosure further containing a plurality of individually sealed cells containing additional reactant chemicals and arranged to be ruptured sequentially as the package expands during a dispensing operation to effect reaction between said additional chemicals and one or more of said set of chemicals to produce additional increments of gas pressure within the sealed enclosure;

that improvement in such a package wherein;

said sealed enclosure comprises a first outer sheet member formed with a plurality of pockets opening into the interior of the enclosure;

at least one of said pockets containing a first chemical component of said set of chemicals;

at least another of said pockets containing a second chemical component of said set of chemicals and capable of reacting with said first chemical component to develop an initial dispensing gas pressure;

said plurality of pockets in said first outer sheet member further comprising a set of pockets containing additional chemical material capable of reacting with at least one of said chemical components to develop further dispensing pressure;

said sealed enclosure including a second outer sheet member sealed peripherally to said first outer sheet member to form therewith said sealed enclosure encompassing all of said pockets;

a tape member between said first and second outer sheet members and positioned over the openings of said set of pockets, said tape member being sealed around the peripheries of said openings to prevent said chemical material therein from coming into contact with said chemical components;

said tape member being secured to said second outer sheet member to provide for progressive lift-off of said tape member from said first outer sheet member to open the peripheral seals around said set of pockets in sequence as the two outer sheet members separate during a dispensing operation, thereby permitting reactive contact between said additional chemical material and at least one of said chemical components to develop additional increments of gas pressure within said package.

2. A package as claimed in claim 1 formed in a generally rectangular plan configuration;

said first pocket being located at one end of said package;

said second pocket being located approximately centrally between the ends of said package.

3. A package as claimed in claim 2, wherein said second pocket is located close to one long side of the package configuration;

said set of pockets being located adjacent said second pocket, and along the other long side of said package configuration.

4. A package as claimed in claim 3, wherein said tape member is sealed to said second outer sheet member along a line located centrally between said two long sides, and at least approximately parallel thereto.

5. A package as claimed in claim 2, wherein said second pocket comprises a plurality of separate sections formed to allow liquid communication therebetween.

6. A package to be inserted in a container for developing expansive pressure to force out and dispense the contents of the container, comprising:

(A) a first outer sheet member formed with a plurality of pockets;

at least one of said pockets containing a first chemical component;

at least another of said pockets containing a second component capable of reacting with said first chemical component to develop an initial dispensing gas pressure;

said plurality of pockets further comprising a set of pockets containing additional chemical material capable of reacting with at least one of said chemical components to develop further dispensing pressure;

(B) a second outer sheet member sealed peripherally to said first outer sheet member to form therewith a sealed enclosure encompassing all of said pockets;

(C) a tape member between said outer sheet members and positioned over the openings of said set of pockets, said tape member initially being sealed around the peripheries of said openings to prevent said chemical material from coming into contact with either of said chemical components; and (D) said tape member being secured to said second sheet member to provide for progressively opening the peripheral seals around said set of pockets as the two sheet members separate during a dispensing operation, thereby permitting reactive contact between said chemical material and at least one of said chemical components to develop additional gas pressure within said package.

7. A package as in claim 6 arranged in rectangular format;

said one pocket being located near one end of the rectangular configuration;

said another pocket being located between said one pocket and the other end of said rectangular configuration.

8. A package as in claim 7, wherein said another pocket is located close to one long side of the rectangle;

said set of pockets being located close to the other side of the rectangle.

9. A package as in claim 8, wherein said tape member is secured to said second outer sheet member by a seal line running parallel to the long sides of said rectangle.

10. A package as in claim 6, wherein said sheet members and said tape member are secured together by heat sealing, the materials of said sheet members and said tape member being selected to provide a strong peripheral seal between said sheet members, a strong seal between said second sheet member and said tape member, and a weak seal between said tape member and said first sheet member.

11. A package as in claim 10, wherein said materials are selected to provide a polypropylene-to-polyethylene seal between said tape member and said first sheet member.

12. A package as in claim 11, wherein said materials are selected to provide a polyethylene-to-polyethylene seal between said second sheet member and said tape member.

13. A package as in claim 12, wherein said two sheet members are polyethylne/polypropylene films with the polyethylene facing inwardly;

said tape member being a polyethylene/polyester/-polypropylene film, with the polypropylene facing said first sheet member to develop a light-pulling-force seal therewith.

14. The method of making a sealed package for developing expansive pressure within a dispensing container, comprising the steps of:

forming a first sheet member with at least first and second separate pockets and an additional set of pockets;

depositing in said first and second pockets first and second chemical components which are capable of reacting together to produce gas pressure;

depositing into said additional set of pockets a chemical material capable of reacting with one of said chemical components to develop gas pressure;

positioning a tape member over the openings of said additional set of pockets;

sealing a second sheet member to said first sheet member with a peripheral seal to establish a sealed enclosure encompassing all of said pockets and said tape member; and securing said second sheet member to said tape member to provide for progressive lift-off of said tape member from said set of pockets when the two sheet members separate as the package expands during a dispensing operation.

15. The method of claim 10, wherein said package is formed with a rectangular plan outline;

said first pocket being formed near one end of the rectangle;

said second pocket being formed between said first pocket and the other end of the rectangle.

16. The method of claim 11, wherein said second pocket is formed adjacent one long side of the rectangle;

said set of pockets being formed adjacent the other long side of the rectangle.

* * * * *